US005467934A

United States Patent [19]

del Mar Segura Salvador et al.

[11] Patent Number: 5,467,934

[45] Date of Patent: Nov. 21, 1995

[54] BRAKING SYSTEM FOR BOBBIN-HOLDER SUPPORTS

[76] Inventors: Maria del Mar Segura Salvador; Silvia B. Segura Salvador, both of Plaza de la Constitucion 2, 04230 Buercal de Almeria, Spain

[21] Appl. No.: 217,506

[22] Filed: Mar. 24, 1994

Related U.S. Application Data

[63] Continuation-in-part of Ser. No. 910,704, Jul. 8, 1992, abandoned.

[30] Foreign Application Priority Data

Jul. 8, 1991 [ES] Spain ..... 9101594

[51] Int. Cl.[6] ..... B65H 23/08

[52] U.S. Cl. ..... 2.42/421.4; 242/422.2

[58] Field of Search ..... 242/421.4, 422.2, 242/422.1, 156, 156.2, 390.6; 188/266, 280

[56] References Cited

U.S. PATENT DOCUMENTS

| | | | |
|---|---|---|---|
| 2,631,790 | 3/1953 | Wheldon . | |
| 2,631,791 | 3/1953 | Wheldon . | |
| 2,636,693 | 4/1953 | Littel et al. | 242/421.4 |
| 2,759,684 | 8/1956 | Cross | 242/390.6 |
| 3,036,787 | 5/1962 | Triquet . | |
| 3,158,356 | 11/1964 | Carlson et al. | 242/390.6 |
| 3,558,074 | 1/1971 | Held | 242/421.4 X |
| 3,861,496 | 1/1975 | Hoover . | |
| 4,007,816 | 2/1977 | Bayles et al. . | |
| 4,114,827 | 9/1978 | Maier | 242/390.6 |
| 4,176,805 | 12/1979 | Jackson | 242/422.1 |

FOREIGN PATENT DOCUMENTS

| | | | |
|---|---|---|---|
| 396814 | 8/1933 | United Kingdom | 242/422.1 |
| 797429 | 7/1958 | United Kingdom . | |
| 972210 | 10/1964 | United Kingdom . | |
| 1251536 | 10/1971 | United Kingdom . | |

*Primary Examiner*—John M. Jillions
*Attorney, Agent, or Firm*—Ostrolenk, Faber, Gerb & Soffen

[57] ABSTRACT

A braking system for bobbin holders for holding a bobbin. A closed oleo-hydraulic circuit adapted to increase the flow of oleo-hydraulic fluid to two connected fluid gear pumps and reduction units. The increased fluid pressure to the gear pumps brake rotation of the bobbin-holders as the inertial racing of the bobbin increases, e.g. with the unwinding of sheet material on the bobbin. The oleo-hydraulic circuit includes a pressure regulator and a solenoid valve for transmitting oleo-hydraulic fluid contained in a tank through the oleo-hydraulic circuit past both gear pumps.

5 Claims, 1 Drawing Sheet

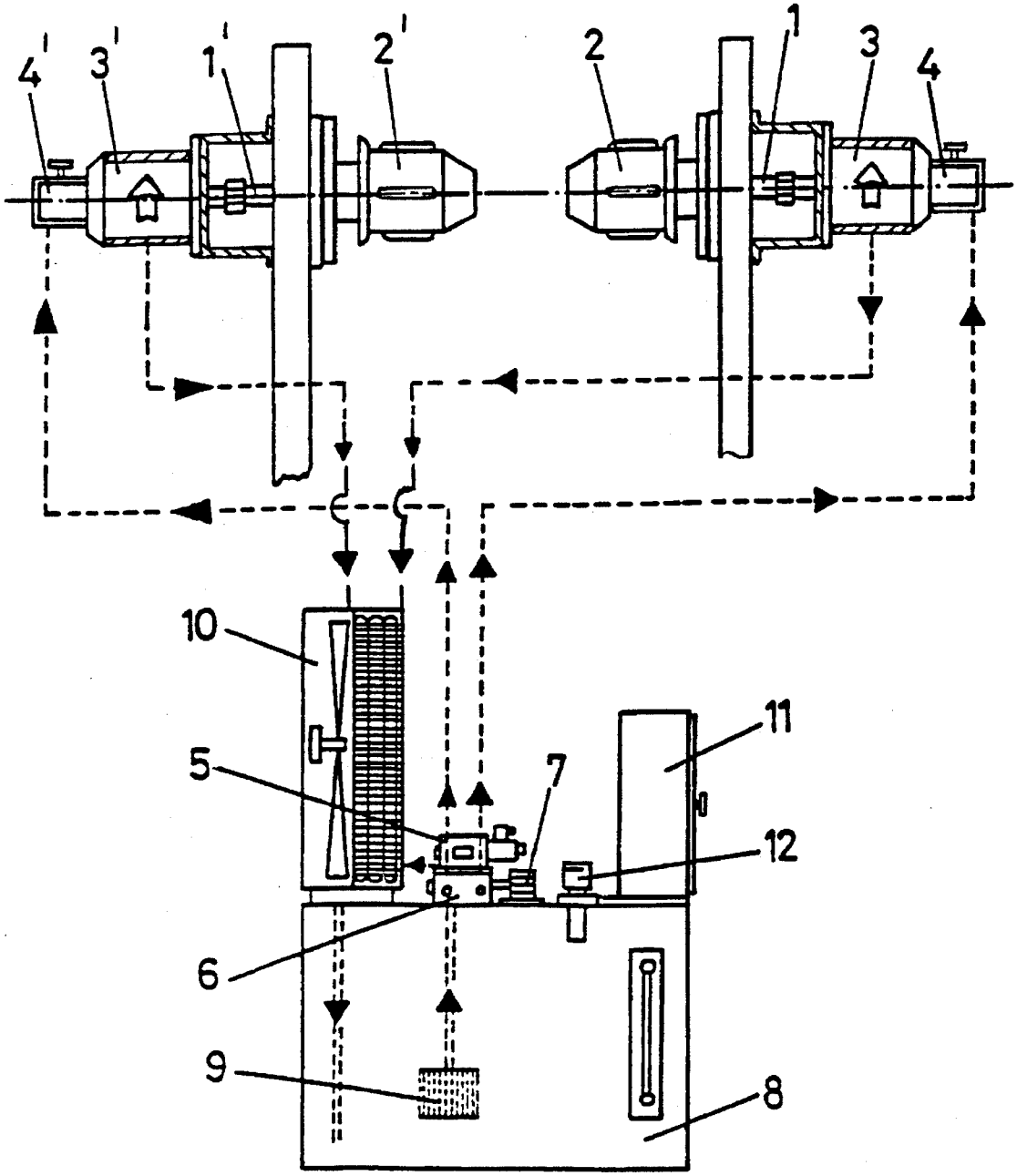
4'
3'
1'
2'
2
1
3
4
10
5
7
11
12
6
9
8

BRAKING SYSTEM FOR BOBBIN-HOLDER SUPPORTS

BACKGROUND OF THE INVENTION

This is a continuation-in-part application of U.S. Ser. No. 07/910,704, filed Jul. 8, 1992 now abandoned.

FIELD OF THE INVENTION

The present invention relates to a braking system for bobbin-holder supports. More particularly, the invention relates to a closed oleo-hydraulic circuit, connected to the bobbin holder support system, adapted to increase the flow of oleo-hydraulic fluid supplied to respective gear pumps driving the bobbin-holder supports as the inertial racing of the bobbin increases with unwinding of the sheet material wound on it.

DESCRIPTION OF THE PRIOR ART

As is well known, when sheet material wound on a bobbin unwinds, the tension or traction of the sheet unwinding causes racing of the bobbin to occur. The racing increases as the quantity of sheet material left on the bobbin decreases through the effect of inertia which develops in the bobbin.

In order to avoid this serious disadvantage, there currently exist various means of braking, such as electrical and pneumatic systems. These systems, however, encounter problems of wear by friction and problems due to the high temperatures reached.

Moreover, the known braking systems generally use mechanical transmission arrangements that often malfunction. Also, such braking systems provide braking action at only one of the two bobbin holder supports, which support a bobbin mounted between them, thereby providing less effective braking of the bobbin holder supports.

SUMMARY OF THE INVENTION

Accordingly, it is an object of the present invention to eliminate these disadvantages by application of an oleo-hydraulic pressure braking system to a bobbin support system. A pair of bobbin holder cones support a bobbin mounted between them. The bobbin holder cones are connected by driving shafts to a pair of gear pumps. A closed oleo-hydraulic circuit, comprising a pump for transmitting oleo-hydraulic fluid to the gear pumps and a solenoid distribution valve for regulating the flow of the fluid, is connected to the gear pumps through respective reduction units. The solenoid distribution valve increases the flow of the fluid to the gear pumps as inertial racing of the bobbin increases for braking the bobbin holder supports.

Other features and advantages of the present invention will become apparent from the following description of the invention which refers to the accompanying drawings.

BRIEF DESCRIPTION OF THE DRAWING

The drawing shows a schematic arrangement of the braking system.

DETAILED DESCRIPTION OF THE INVENTION

The arrangement shown in the drawing for each of two bobbin holder cones is duplicated. The first arrangement is described. The other shown with prime (') numbers is a duplicate structure where the same numbers are used.

The arrangement includes a shaft 1 which connects bobbin holder cone 2 to a gear pump 3. One end of a bobbin (not shown) would be received on the cone. The gear pump 3 is driven by the shaft 1 to rotate by rotation of the cone 2. The pump is fit with a reduction unit 4. The reduction unit 4 is suitably coupled to and supplied with oleo-hydraulic fluid by means of a solenoid valve 5, a fluid pressure regulator 6 and a corresponding motor 7. The pressure regulator 6 obtains the oleo-hydraulic fluid from oil tank 8, through aspiration filter 9, which provides a constant flow of oleo-hydraulic fluid to the oleo-hydraulic circuit.

The fluid aspirated by means of the pressure regulator 6 is conveyed through the solenoid valve 5 in a sealed circuit to the reduction unit 4. From there the fluid passes to the pump 3 which is connected by shaft 1 to bobbin holder cone 2 and, from there to the tank 8, passing through cooling equipment 10.

Similarly, the fluid circulation is extended to the reduction unit 4' and the pump 3', which is connected to the corresponding driving shaft 1'. The fluid passes to the reduction unit 4' from the pressure regulator 6 through the solenoid valve 5 and, from there to the pump 3' from which the fluid returns to the tank 8, passing through cooling equipment 10.

The cooler 10, the pressure regulator 6 and the solenoid valve 5, can be mounted on the tank 8 itself. A control panel 11 for the arrangement is mounted there too. Also, the tank 8 has a filling valve 12.

Upon the acceleration of a bobbin (not shown) held between the bobbin holder cones 2, 2', mainly because of unwinding of its contents, the cones 2, 2' rotate at a higher speed. The corresponding driving shafts 1, 1', attached with each cone 2, 2', drag the associated operative parts, that is, the gear pumps 3, 3' as well as the reducers 4, 4' at a higher speed. Accordingly, more fluid is required to be pumped from the tank 8 through the regulator 6 and the valve 5 to the reducers 4, 4'.

The braking of the bobbin supports occurs as the increased flow of fluid, which enters the pumps 3, 3' and the reducers 4, 4', is impeded at the respective outlets, which are previously formed for a predetermined flow therethrough. The resulting extra pressure in the pumps 3, 3' and in the reducers 4, 4' opposes their rotation at a higher speed and, therefore, they act as brakes on the corresponding driving shafts 1, 1'.

The reducers 4, 4', which may be hydraulic motors of the orbital type, regulate the flow of fluid into the corresponding gear pumps 3, 3', and at the same time help to brake the driving shafts 1, 1' in such a way that instantaneous overloads of the corresponding gear pumps 3, 3' can be avoided. Such an overload of the pumps could produce deterioration of the pumps.

In a preferred embodiment, the reducers 4, 4' may also be gear pumps that are coaxially mounted with respect to the corresponding gear pumps, 3, 3'. As discussed above, the driving shafts 1, 1', attached to each cone 2, 2', are also connected to the associated gear pumps 3, 3' and the reducers 4, 4'. The reducers 4, 4' increase the pressure of the fluid passing into the gear pumps 4, 4', thereby increasing the braking of the bobbin supports.

The pressure regulator 6 and the solenoid valve 5 combine to control the flow of fluid to the respective reducers 4, 4'. The pressure regulator 6 acts as a pump, which is operated by the motor 7, and pumps a constant flow of oleo-hydraulic fluid. The solenoid valve 5 is adapted to send the appropriate flow to the reducers 4, 4' and the pumps 3, 3', and returns the rest of the fluid to the tank 8.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A braking system for bobbin holders comprising:

(a) first and second rotatable bobbin holders facing each other for supporting a bobbin between them, rotation of the bobbin causing the bobbin holders to rotate;

(b) first and second gear pumps respectively connected to the first and second holders such that the pumps are rotated by rotation of the respective holder connected thereto; each pump being adapted for receiving a fluid under pressure and being responsive to the fluid in the pump for controlling rotation of the gear pump;

(c) a first and a second reduction unit each being attached to a respective one of the gear pumps, the first reduction unit being adapted for regulating flow of the fluid into the first gear pump and the second reduction unit being adapted for regulating flow of the fluid into the second gear pump; and (d) a closed oleo-hydraulic circuit comprising the reduction units and the gear pumps, the oleo-hydraulic circuit including means for increasing the pressure of the fluid to the respective pumps as rotation of the bobbin increases above a predetermined speed, the increased pressure of the fluid to the respective pumps being predetermined so as to brake the pumps and thereby to brake the bobbin holders.

2. A braking system according to claim 1, further comprising first and second driving shafts respectively for the first and second holders, each shaft having one end attached to the respective bobbin holder and another end connected to the respective gear pump, the driving shafts being adapted for transmitting rotary motion from the holders to the respective gear pumps.

3. A braking system according to claim 1, wherein the flow increasing means of the oleo-hydraulic circuit comprises a tank for the fluid, a pressure regulator pump for pumping the fluid from the tank to the first and the second reduction unit, and a solenoid distribution valve connected between the pressure regulator pump and the first and second reduction unit for controlling the flow of the fluid to the first and second reduction unit.

4. A braking system according to claim 3, further comprising a filter in the oleo-hydraulic circuit for filtering the fluid being transmitted through the oleo-hydraulic circuit.

5. A braking system according to claim 3, further comprising cooling means in the oleo-hydraulic circuit connected to the first and second gear pump for receiving the fluid therefrom and for cooling the fluid and being connected to the tank for returning the cooled fluid to the tank.

* * * * *